US007857033B2

(12) United States Patent
Malausa

(10) Patent No.: US 7,857,033 B2
(45) Date of Patent: Dec. 28, 2010

(54) END-OF-TRAVEL DEVICE FOR ACTUATING SYSTEMS OF ROLLER BLINDS OR SUN SHADES

(75) Inventor: Andrea Malausa, Ponte di Piave (IT)

(73) Assignee: Nice SpA, Oderzo (IT)

( * ) Notice: Subject to any disclaimer, the term of this patent is extended or adjusted under 35 U.S.C. 154(b) by 586 days.

(21) Appl. No.: 11/911,844

(22) PCT Filed: Apr. 21, 2006

(86) PCT No.: PCT/EP2006/061745

§ 371 (c)(1),
(2), (4) Date: Oct. 18, 2007

(87) PCT Pub. No.: WO2006/120115

PCT Pub. Date: Nov. 16, 2006

(65) Prior Publication Data

US 2008/0202699 A1 Aug. 28, 2008

(30) Foreign Application Priority Data

May 6, 2005 (IT) ..... TV2005U0024

(51) Int. Cl.
*E06B 9/40* (2006.01)

(52) U.S. Cl. ..... 160/310; 160/295; 200/47

(58) Field of Classification Search ..... 160/310, 160/293.1, 294, 295, DIG. 17; 200/47
See application file for complete search history.

(56) References Cited

U.S. PATENT DOCUMENTS 1,551,512 A * 8/1925 Goff ..... 200/47
2,276,740 A * 3/1942 Saito ..... 200/47
2,566,824 A * 9/1951 Carlson ..... 200/47
2,951,920 A * 9/1960 Miller ..... 200/47
3,285,325 A * 11/1966 Easton ..... 160/310
3,451,463 A * 6/1969 Lyman ..... 160/23.1
3,474,317 A * 10/1969 Delaney ..... 318/266

(Continued)

FOREIGN PATENT DOCUMENTS

DE 19532115 A1 6/1996

(Continued)

OTHER PUBLICATIONS

International Search Report and Written Opinion dated Aug. 30, 2006 from the corresponding PCT/EP2006/061745.

*Primary Examiner*—David Purol
(74) *Attorney, Agent, or Firm*—Katten Muchin Rosenman LLP

(57) ABSTRACT

End-of-travel device (10) for roller blind actuating systems, comprising a member (22) displaceable as far as an end-of-travel position (26), coupling means (20) in engagement with the displaceable member (22) and rotationally actuated by a motor, and lever means (40) for converting the displacement of the displaceable member (22) into activation of an end-of-travel switch (60). The lever means (40) comprise a movable member (50) pivotably hinged on a frame and engageable with pressure by the displaceable member (22) when its reaches the end-of-travel position (26). The member (50) can be engaged with an actuating member (58) of the switch (60) where an actuating member of the switch (60) is positioned radially with respect to the axis of displacement of the member (22).

10 Claims, 4 Drawing Sheets

U.S. PATENT DOCUMENTS 3,559,024 A * 1/1971 Marder ..... 318/467
3,715,530 A * 2/1973 Dalton ..... 200/47
3,825,809 A * 7/1974 Gatland et al. ..... 318/282
4,247,744 A * 1/1981 Birkle ..... 200/47
4,342,354 A * 8/1982 Leivenzon et al. ..... 160/133
4,615,371 A * 10/1986 Clauss ..... 160/22
5,044,417 A * 9/1991 Bresson ..... 160/310
5,355,741 A * 10/1994 Hsieh ..... 74/2
5,711,360 A * 1/1998 Viotte ..... 160/310
7,161,100 B1 * 1/2007 Hsieh ..... 200/47

FOREIGN PATENT DOCUMENTS

EP 0371170 6/1990
FR 1487414 A 7/1967

* cited by examiner

END-OF-TRAVEL DEVICE FOR ACTUATING SYSTEMS OF ROLLER BLINDS OR SUN SHADES

BACKGROUND OF THE INVENTION

The present invention relates to an end-of-travel device for actuating systems of roller blinds or sun shades, such as shutters, sun awnings, etc.

It is known that in actuating systems for roller blinds (to which reference will be made henceforth for the sake of simplicity, but it being understood that the invention is not limited to this application) for some time automatic end-of-travel devices have been used, namely mechanical or electromechanical devices which cause stoppage of the roller blind when it reaches a predetermined final position.

Many examples of these devices exist in the state of the art. In the patent FR 2,076,529 two gear wheels which advance on associated female screws act on end-of-travel switches (microswitches) displacing flanges which slide coaxially on a smooth portion of the female screws.

In a very similar manner the patent EP 0,371,170 describes actuation of end-of-travel switches by means of gear wheels which advance on associated female screws, where, however, it is the gear wheel itself which acts by means of direct contact on the switch (for this purpose it is chamfered on the contact edge).

These systems, although managing to limit the longitudinal dimensions, do not allow precise adjustment of the end-of-travel stops, resulting in positioning errors of the roller blind. A first cause of error is the sensitivity of the microswitch which is actuated. The commercially available microswitches do not ensure constant operation as regards either the position or the moment of activation, namely they are not always activated at the same moment or in the same position (activation may occur after travelling a third or a half of their total travel path). Moreover, with time their characteristics change. Since the manufacturers of actuating systems use commercially available microswitches, this error cannot be eliminated. On the other hand it is likewise not economically advantageous to produce specific microswitches for this type of application. A second cause of error is the speed with which the microswitch is actuated. This parameter in fact influences the position and the moment of activation. The activation position may be rendered more constant by increasing the speed of actuation of the microswitch.

A commercially known solution is one where end-of-travel microswitches are actuated by gear wheels which advance on associated female screws. In this case, however, the movement of the gear wheels is transferred to the movable part of the microswitch by means of a lever able to multiply the operating speed owing to the different length of its arms. It can be easily understood that the dimensions of the arms of the lever determine directly the performance of the system, but at the same time they are also decisive for the space occupied by the system. However, the dimensions of the actuating system are dependent upon the end-of-travel system, which prevent any shortening thereof. Since the dimensions of the actuating system heavily influence both the practicality of assembly and its cost (production, packaging and storage), it is obvious that this system is not of an optimal nature.

BRIEF SUMMARY OF THE INVENTION

The main object of the present invention is to provide an improved end-of-travel device by means of which the problems and drawbacks briefly mentioned above are substantially solved.

This object is achieved with an end-of-travel device for rotational actuating systems of roller blinds or sun shades, which is mounted on a frame of the roller blind and coupled to a motor for actuating the roller blind, comprising a member displaceable as far as a desired adjustable end-of-travel position, coupling means in engagement with said displaceable member and rotationally actuated by said motor, so that the rotation of said motor and said coupling means causes said displacement of said member, lever means for converting the displacement of said displaceable member into activation of an end-of-travel switch for operating said motor, said lever means comprising a movable member pivotably mounted on the fixed frame and able to be engaged with pressure/thrust by said displaceable member when it reaches said end-of-travel position, the other end of said movable member being engageable with a member for actuating said end-of-travel switch, characterized in that said member for actuating said switch is positioned radially with respect to the axis of displacement of said member, so that when said rotating member reaches said end-of-travel position and engages by means of pressure/thrust with said movable member, said movable member is made to rotate about the pivoting point on the frame, consequently actuating said end-of-travel switch.

In the particular embodiment of the present invention, said arm of the lever means is L-shaped and has a first branch which has an end pivotably mounted on said frame and is engaged with pressure/thrust by said rotating member during its displacement when it reaches the end-of-travel position. The second branch of said arm engages by means of pressure/thrust with the member for actuating said end-of-travel switch.

This innovative idea allows the longitudinal dimensions of the actuating system to be reduced substantially, with all the advantages arising therefrom.

BRIEF DESCRIPTION OF THE INVENTION

These and further advantages will emerge more clearly from the following description of the device according to the invention, with reference to the accompanying drawings in which.

DETAILED DESCRIPTION OF THE INVENTION

Figure 1:
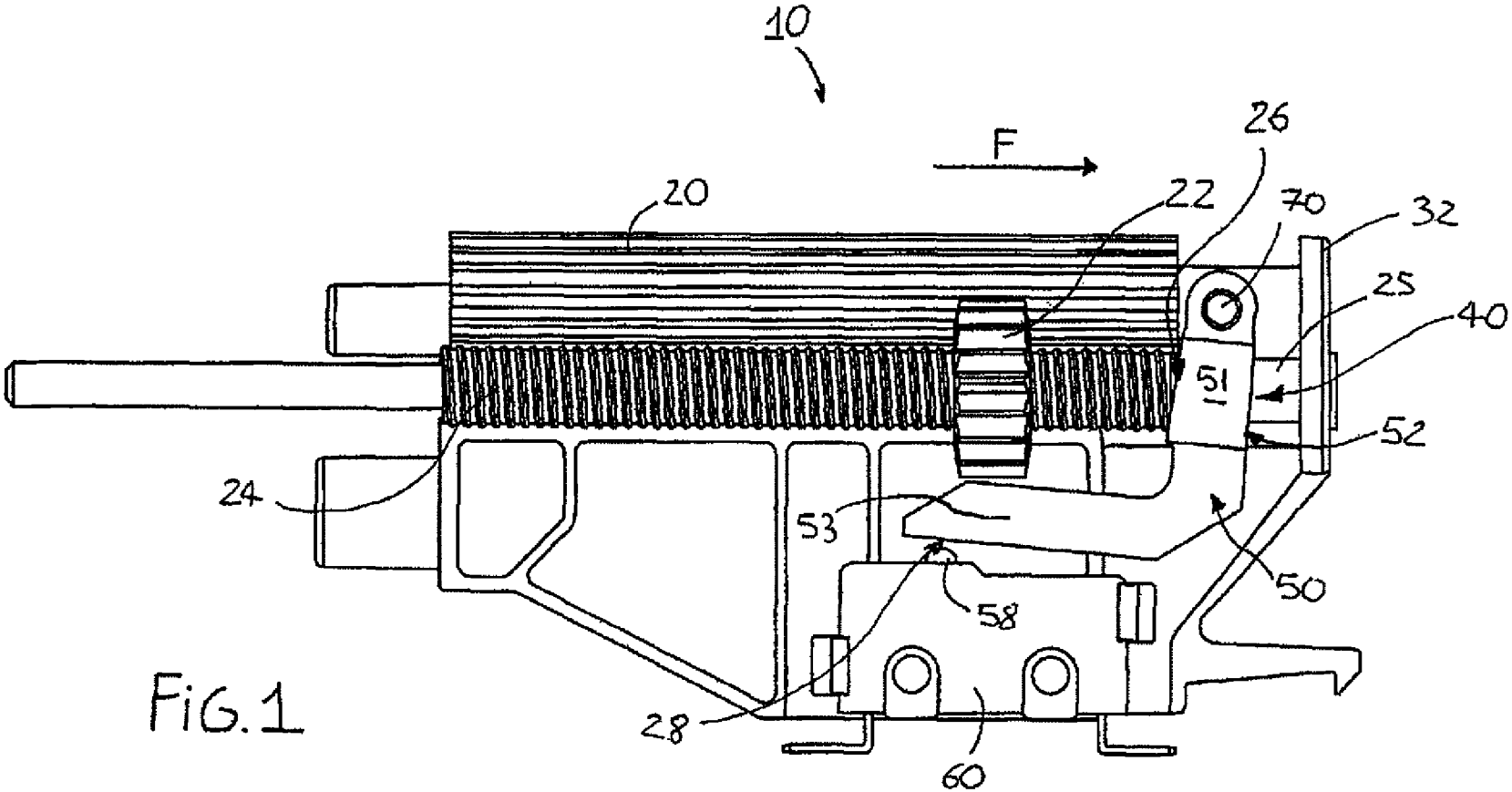
FIG. 1 shows a side view of the device according to the invention.
Figure 2:
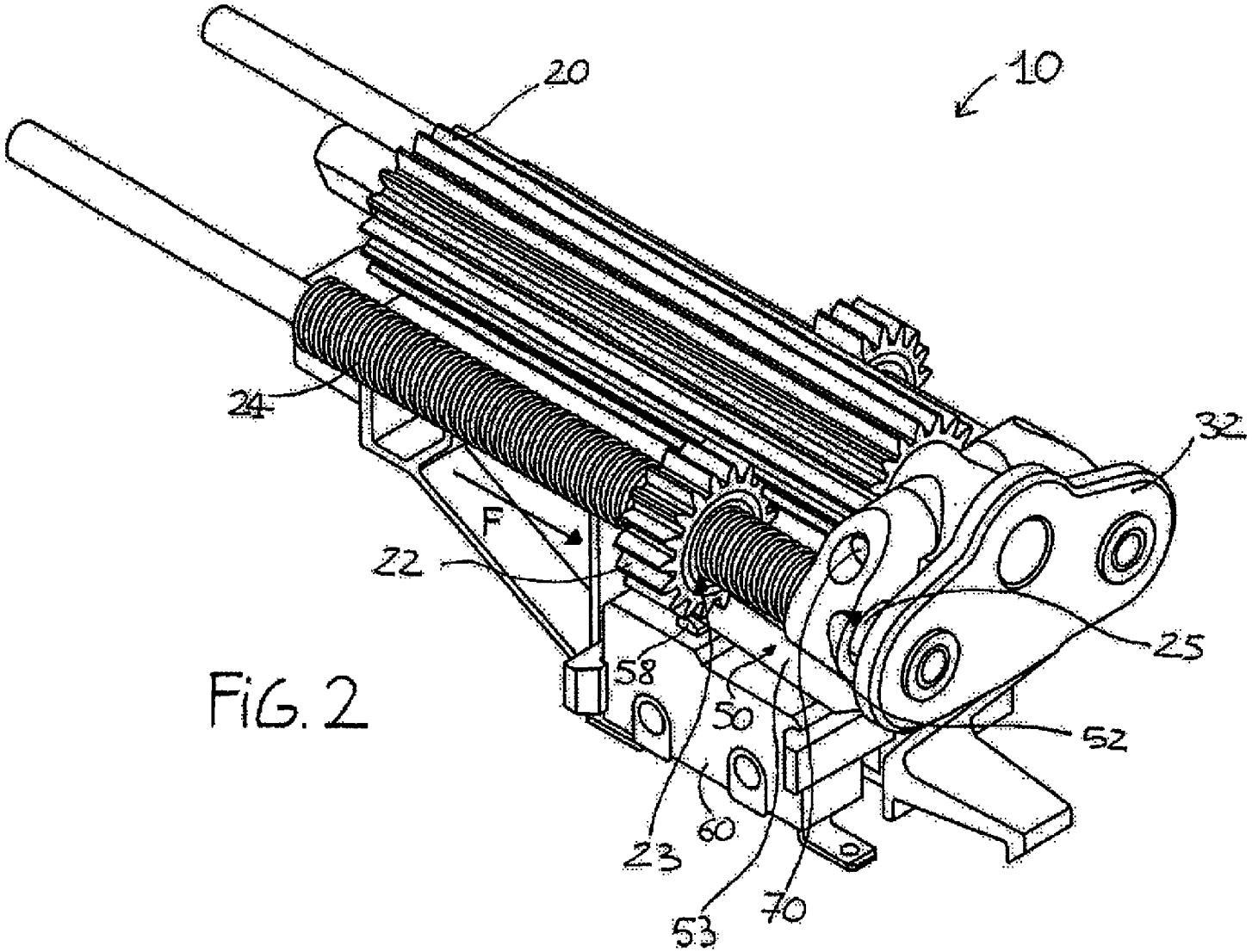
FIG. 2 shows an axonometric view of the device according to FIG. 1 from above.
Figure 3:
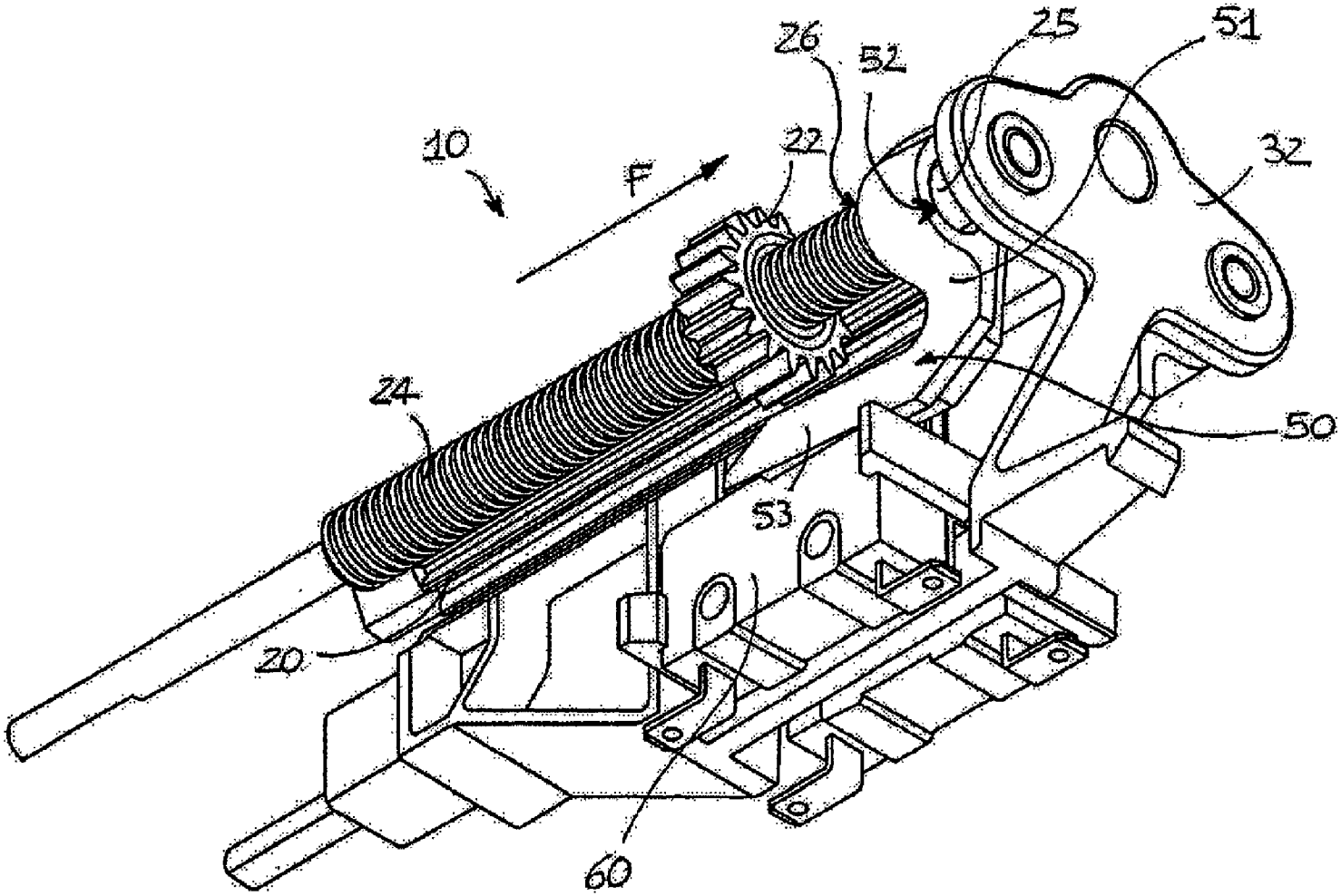
FIG. 3 shows an axonometric view of the device according to FIG. 1 from below.

In the figures of the entire structure of the roller blind only the portion of interest in the region of the end-of-travel system is shown. With reference to the accompanying figures, a device according to the invention is denoted by 10. It normally and preferably consists of two identical end-of-travel devices which are arranged laterally alongside each other and only one of which for the sake of simplicity and brevity will now be described.

The device 10 comprises a rotating splined cylinder 20 mating with a gear wheel 22 which in turn engages, by means of its threaded central hole 23, with the thread of a fixed female screw 24 arranged parallel to the cylinder 20. Both the female screw 24 and the cylinder 20 are supported by a bracket 32 mounted on the frame of the roller blind (the other ends of the female screw 24 and the cylinder 20 are likewise supported by a similar bracket).

By means of a known mechanism, not shown, the motor for rotation of the roller blind (not shown) causes the rotation of said cylinder 20 about its longitudinal axis and consequently the gear wheel 22 advances on the female screw 24 in relation to the rotational movement of the roller blind (direction F in the figures). The advancing movement of the gear wheel 22 along the female screw 24 continues until it reaches an end-of-travel position where it encounters lever means 40 at a pressure/thrust point 26.

The lever means 40 comprise a movable L-shaped arm 50 having the free end of a first branch 51 hinged about a pivot pin 70 on the aforementioned frame. From the figures it can be readily seen that the branch 51 of the lever means 40 has in its thickness a hole 52 inside which a smooth cylindrical portion 25, i.e. without threading, of the female screw 24 passes in a freely slidable manner. In particular the diameter of the hole 52 has dimensions such that between the outer surface of the female screw 24 and the inner wall of the hole 52 there is sufficient play to allow pivoting of the lever means 40 about the fulcrum 70 in a plane passing through the axis of the female screw 24. It is evident that this result may also be achieved by providing the smooth portion 25 with a diameter smaller than that of the main body of the female screw 24.

The second branch 53 of the arm 50, which in the embodiment shown is situated at an angle preferably of ninety degrees with respect to the branch 51, engages, in the position indicated by the reference number 28, with the actuating member or pushbutton 58 of an end-of-travel switch 60, which is advantageously a microswitch. With this configuration it is possible to position the end-of-travel switch and in particular its actuating pushbutton 58 in a position radially spaced from the axis of the female screw 24, but within the limits of the longitudinal dimensions of the said female screw, therefore allowing shortening of the longitudinal length of the roller blind to the length of the female screw without any further extension. As can be seen from the Figures, the operating principle of the invention is as follows: when the gear wheel 22 reaches the end-of-travel position at the pressure/thrust point, it exerts at this point 26 a force on the first branch 51, so that the branch 50 rotates about the fulcrum 70. Owing to this rotation, the second branch 53 of the arm 50 in turn exerts on the contact point 28 an activating force on the pushbutton 58 of the end-of-travel switch 60. When the switch 60 is activated, actuating means (not shown) causes stoppage or reversal (and/or another function) of the roller blind. Then the roller blind may move only in the reverse direction, causing reverse rotation of the cylinder 20 and forward movement of the wheel 22 in a direction opposite to the previous direction F.

In order to provide two end-of-travel positions it is possible to use two separate devices (one per position), as shown in the figures, or arrange a second movable pivoting member on the other end of the female screw 24 so as to activate a second end-of-travel switch.

Figure 4:
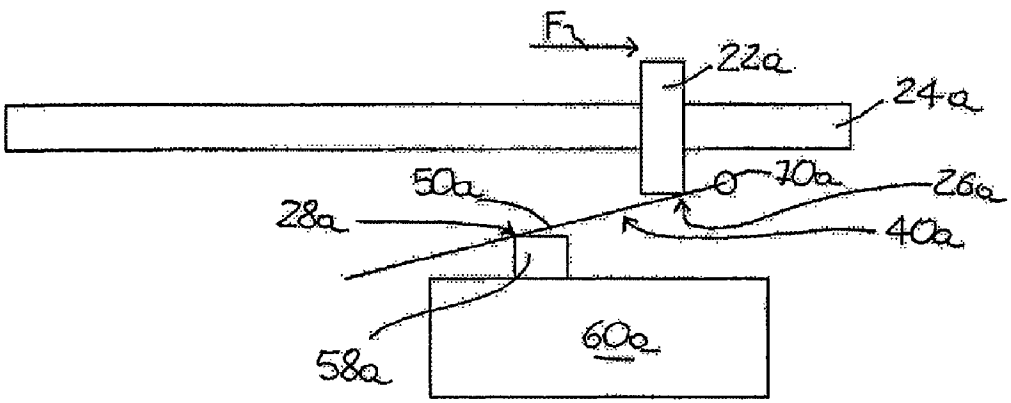
FIG. 4 shows schematically another side view of the device.
Figure 5:
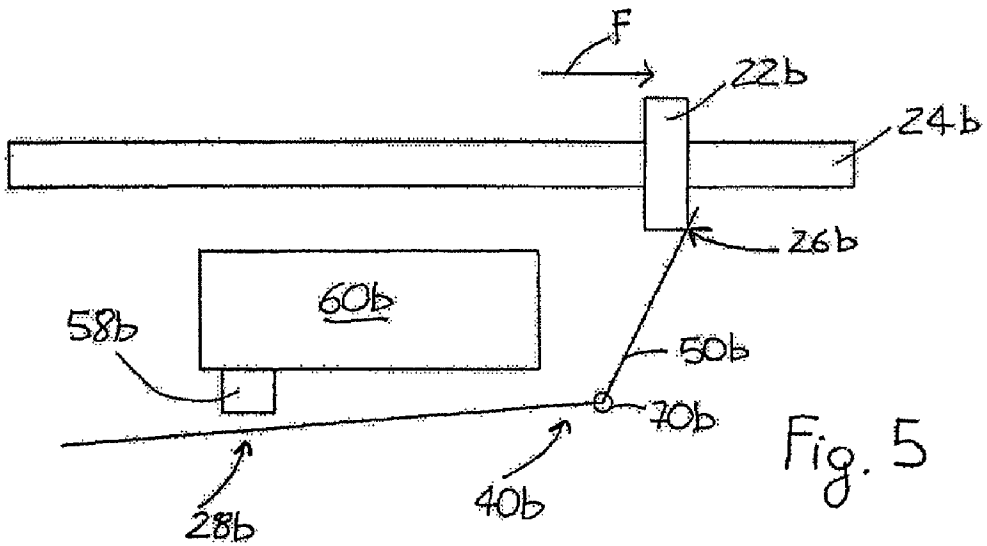
FIG. 5 shows schematically another side view of the device.

With reference to FIGS. 4 and 5, a schematic description is now given of two mechanical equivalents of the invention and which are third order levers, the parts of which constructionally identical to the already described parts will be distinguished by the suffixes "a" and "b", respectively, parts not named remaining the same even if not shown.

In FIG. 4 a gear wheel 22*a* advances rotating on the thread of a female screw 24*a* in relation to the movement of the roller blind (direction F in the figure). As it advances, the gear wheel 22*a* reaches an end-of-travel position at a pressure/thrust point 26*a* where it encounters lever means 40*a* comprising a straight movable arm 50*a* with its fulcrum on the pivot pin 7*a*. The movable arm 50*a*, when it is engaged by the gear wheel 22*a*, rotates about its fulcrum 70*a* and exerts, at a point 28*a*, an activating force on a pushbutton 58*a* of an end-of-travel switch 60*a*. Here the movable member 50*a* is pivotably hinged in a position adjacent to the pressure point 26*a*. With respect to the female screw 24, the pin 70*a* and the pressure point 26*a* are radially on the same side.

In FIG. 5 a gear wheel 22*b* advances rotating on the thread of a female screw 24*b* in relation to the movement of the roller blind (direction F in the figure). As it advances, the gear wheel 22*b* reaches an end-of-travel position at a pressure/thrust point 26*b* where it encounters lever means 40*b* comprising a movable V-shaped member 50*b* with its fulcrum on a pivot pin 70*b*. The movable member 50*b* exerts, at a point 28*b*, an activating force on a pushbutton 58*b* of an end-of-travel switch 60*b*. In this case the movable member 50*b* is pivotably hinged in a position less than about halfway between the pressure/thrust point 26*b* and the point 28*b* of application of the activating force. The switch 60*b*, unlike the previous examples, does not have its pushbutton 58*a* directed towards the female screw 24*b* (i.e. is directed radially away from the female screw 24*b*).

When the gear wheel 22*b* reaches the end-of-travel position at the pressure/thrust point 26*b*, it exerts a force on the movable member 50*b* which, rotating about the fulcrum 70*b*, exerts at the point 28*b* an activating force on the pushbutton 58*b* of the end-of-travel switch 60*b*.

For the invention, as lever means it is possible to use any type of passive kinematic mechanism, for example hinged transmission or gear systems particular types of levers). Moreover, for the lever means, it is possible to make use of the activating bar already present in some commercially available microswitches.

It is mentioned that, instead of the female screw and the thread type system for coupling with the rotating member, it is possible to use equivalent mechanisms provided that they allow displacement of a movable member, controlled by rotation of the roller blind motor.

The invention claimed is:

1. End-of-travel device (10) for rotational actuating systems of roller blinds or sun shades, mounted on a frame of the actuating system and coupled to an actuating motor of the roller blind, comprising a displaceable member (22; 22*a*; 22*b*) which is axially displaceable to an adjustable end-of-travel position (26), an axial coupling means (20) in engagement with said displaceable member (22; 22*a*; 22*b*) and rotationally actuated about its axis, so that the rotation of said motor and said coupling means causes said axial displacement of said displaceable member (22; 22*a*; 22*b*), lever means (40) for converting the axial displacement of said displaceable member (22; 22*a*; 22*b*) into an action on an end-of-travel switch (60) for operating said motor, said lever means (40) comprising a movable member (50; 50*a*; 50*b*) pivotably mounted on the frame and engageable by pressure from said displaceable member (22; 22*a*; 22*b*) when it reaches said end-of travel position (26), the other end of said movable member (50; 50*a*; 50*b*) being engageable with an actuating member (58; 58*a*; 58*b*) of said end-of-travel switch (60; 60*a*; 60*b*), characterized in that said end of travel switch is positioned co-axially with said axial coupling means, and said actuating member (58; 58*a*; 58*b*) of said switch (60; 60*a*; 60*b*) is radially actuated with respect to the axis of displacement of said displaceable member (22; 22*a*; 22*b*), so that when said displaceable member (22; 22*a*; 22*b*) reaches said end-of-travel position, said displaceable member pushes and applies said pressure to said movable member (50; 50*a*; 50*b*), and said movable member (50; 50*a*; 50*b*) rotates about a pivoting point on the frame, consequently activating said end-of-travel switch, and said lever means (40) forms a lever of the third order.

2. Device (10) according to claim 1, in which said lever means (40) comprise a single movable member (50).

3. Device (10) according to claim 1, in which said displaceable member is a gear wheel (22) having a threaded central hole which in turn engages, with an axial thread of a fixed female screw (24) inserted in said threaded central hole.

4. Device (10) according to claim 3, in which, with respect to the axis of the female screw (24), the pivoting point of said movable member (50) is along an axis which is transverse to both the axis of the female screw (24) and transverse to the radial direction of the actuation (50) of said end-of-travel switch (60).

5. Device (10) according to claim 4, in which said movable member (50) is L shaped having an extension arm connected to an actuating arm, a distal end of said extension arm being pivotably hinged about a pin (70) on said frame, at said pivoting point.

6. Device (10) according to claim 5, in which said movable member (50) comprises along its extension arm a ring (52) inside of which a smooth cylindrical portion (25) of the female screw (24) passes, the diameter of the inside of the ring (52) being such as to leave play with respect to a body of the smooth portion (25) and allow pivoting of the movable member (50) about the pin (70).

7. Device (10) according to claim 3, in which the movable member (50*a*) is pivotably hinged with a pin (70*a*) in a position adjacent to a point (26*a*) where the displaceable member applies the pressure on the moveable member and, the pin (70*a*) and the pressure point (26*a*) are radially on a same side of the female screw.

8. Device (10) according to claim 3, in which the movable member (50*b*) is pivotally hinged with a pin (70*b*) in a position less than halfway between a point (26*b*) where the displaceable member applies the pressure on the moveable member and the actuating member of said end-of-travel switch (60*a*), said actuating member (28*b*) being directed radially away from the female screw (24*b*).

9. Device (10) according to claim 1, in which said coupling means (20) in engagement with said displaceable member (22; 22*a*; 22*b*) comprise a rotating splined cylinder (20).

10. Device (10) accordingly to claim 1, wherein said end-of-travel switch is axially positioned before said end-of-travel position.

* * * * *